United States Patent [19]

Kazuhiko Takai

[11] Patent Number: 4,905,477

[45] Date of Patent: Mar. 6, 1990

[54] REFRIGERANT CIRCUIT WITH PASSAGEWAY CONTROL MECHANISM

[75] Inventor: Kazuhiko Takai, Maebashi, Japan

[73] Assignee: Sanden Corporation, Isesaki, Japan

[21] Appl. No.: 213,338

[22] Filed: Jun. 30, 1988

[30] Foreign Application Priority Data

Jun. 30, 1987 [JP] Japan ..... 62-160969

[51] Int. Cl.[4] ..... F25B 41/00

[52] U.S. Cl. ..... 62/196.3; 62/217; 62/228.5; 417/311

[58] Field of Search ..... 417/307, 311, 295; 62/228.5, 228.3, 196.3, 217

[56] References Cited

U.S. PATENT DOCUMENTS

| | | | |
|---|---|---|---|
| 2,734,346 | 2/1956 | Dickieson, Jr. | 62/217 X |
| 2,988,263 | 6/1961 | Fugt | 417/295 |
| 3,855,813 | 12/1974 | St. Laurent | 62/196.3 |
| 3,861,829 | 1/1975 | Roberts et al. | 417/53 |
| 3,924,417 | 12/1975 | Heidorn | 62/217 X |
| 4,037,993 | 7/1977 | Roberts | 417/222 |
| 4,145,163 | 3/1979 | Forgelberg et al. | 417/222 |
| 4,428,718 | 1/1984 | Skinner | 417/222 |
| 4,459,817 | 7/1984 | Inagaki et al. | 62/196.3 |
| 4,557,670 | 12/1985 | Inagaki et al. | 417/299 |
| 4,586,874 | 5/1986 | Hiraga et al. | 417/222 |
| 4,669,272 | 6/1987 | Kawai et al. | 62/228.3 |
| 4,687,419 | 8/1987 | Suzuki et al. | 417/222 |
| 4,702,677 | 10/1987 | Takenaka et al. | 417/222 |
| 4,759,692 | 7/1988 | Morse | 417/307 |

*Primary Examiner*—William E. Wayner

*Attorney, Agent, or Firm*—Banner, Birch, McKie & Beckett

[57] ABSTRACT

A refrigerant circuit with a passageway control mechanism is disclosed which includes a compressor, a condenser and an evaporator connected to each other in series. The passageway control mechanism is disposed between an outlet side of the evaporator and an inlet side of the compressor and operates to change the size of an opening area of a passageway therebetween responsive to the pressure difference between high and low pressure areas within the compressor.

12 Claims, 6 Drawing Sheets

REFRIGERANT CIRCUIT WITH PASSAGEWAY CONTROL MECHANISM

TECHNICAL FIELD

This invention relates to refrigerant circuits generally, and more particularly, to a refrigerant circuit having a passageway control mechanism for use in an air conditioning system.

BACKGROUND OF THE INVENTION

Refrigerant circuits for use in air conditioning systems are well known, and may be of the orifice type, which includes a compressor, a condenser, an orifice, an evaporator and an accumulator, or the expansion valve type, which includes a compressor, a condenser, a receiver dryer, an expansion valve and an evaporator. In these conventional refrigerant circuits if the compressor is started at a time when the refrigerant pressure at the inlet side of the compressor equals the gas pressure at the outlet side, an increase in the drive torque of the compressor results as refrigerant gas flows from the inlet to the outlet, thereby causing a reduction in the rotational frequency of the drive source. This, for example, in the refrigerant circuit for an automotive air conditioning system, reduction of the rotational frequency of the automotive engine may cause torque shock.

Further, in a refrigerant circuit including a compressor with a variable capacity mechanism for uniformly controlling suction pressure, pressure loss increases with increases in passageway resistance between an outlet of the evaporator and an inlet of the compressor in accordance with an increase in the flow rate of refrigerant. Accordingly, refrigerant pressure at the outlet of the evaporator increases responsive to an increase in pressure loss. This then raises the temperature of air which is passed through the evaporator, and reduces the air conditioning capacity.

Because this type of compressor maintains a uniform suction pressure, the temperature of air passing through the evaporator will also be maintained at a constant level. As a result, the air temperature can not be readily controlled in accordance with changes in the automobile atmosphere or the desires of the passengers.

SUMMARY OF THE INVENTION

It is a primary object to this invention to provide a refrigerant circuit having a passageway control mechanism which prevents the occurence of torque shock when the compressor is started.

It is another object of this invention to provide a refrigerant circuit with a passageway control mechanism which prevents the temperature of air passing through the evaporator from varying in accordance with changes in the flow rate of refrigerant.

It is a further object of this invention to provide a refrigerant circuit having a passageway control mechanism for adjusting the temperature of air passing through the evaporator by controlling the pressure of refrigerant at the outlet of the evaporator.

A refrigerant circuit with a passageway control mechanism according to the present invention includes a compressor, a condenser and an evaporator connected to each other in series. The passageway control mechanism is disposed between an outlet side of the evaporator and an inlet side of the compressor and is operated to adjust the opening area of a passageway therebetween responsive to pressure differences within the compressor.

Further objects, features and other aspects of this invention will be better understood from the following detailed description of the invention taken in conjunction with the accompanying drawings.

BRIEF DESCRIPTION OF THE DRAWINGS

FIG. 8 (*b*) is a graph illustrating the relationship between pressure and flow volume of refrigerant.

DETAILED DESCRIPTION OF THE INVENTION

Figure 1:
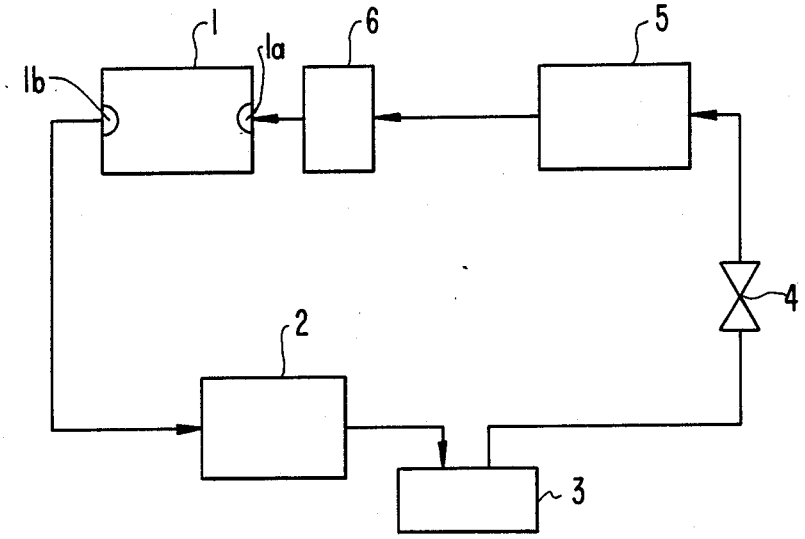
FIG. 1 is a schematic view of a refrigerant circuit having a passageway control mechanism in accordance with a first embodiment of this invention.

Referring to FIG. 1, there is shown a block diagram of a refrigerant circuit. The refrigerant circuit comprises a compressor 1 having a variable displacement mechanism, a condenser 2, a receiver dryer 3, an expansion valve 4, an evaporator 5 and a passageway control mechanism 6, which are connected to each other in series. In operation, refrigerant sucked through inlet 1a is compressed by compressor 1 and discharged to condenser 2 through outlet 1b. The discharged refrigerant gas is then converted into liquid refrigerant at condenser 2 and accumulated in receiver dryer 3. From receiver dryer 3, the refrigerant is sent to evaporator 5 through expansion valve 4, where it is changed into gas, and returned to inlet 1a of compressor 1 through passageway control mechanism 6.

Figure 3:
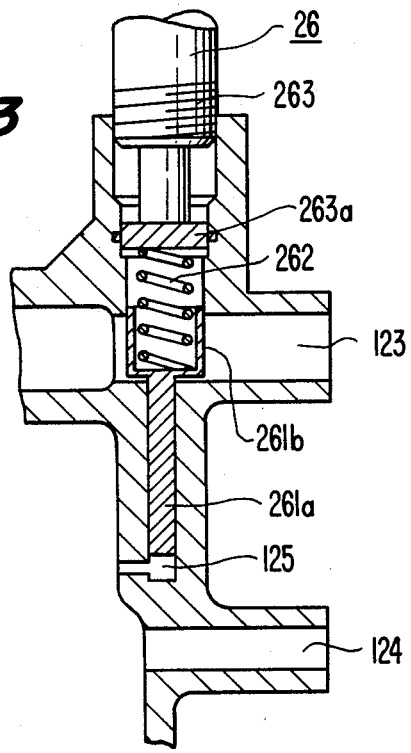
FIG. 3 is a cross-sectional view of a passageway control mechanism according to a first embodiment of this invention.
Figure 2:
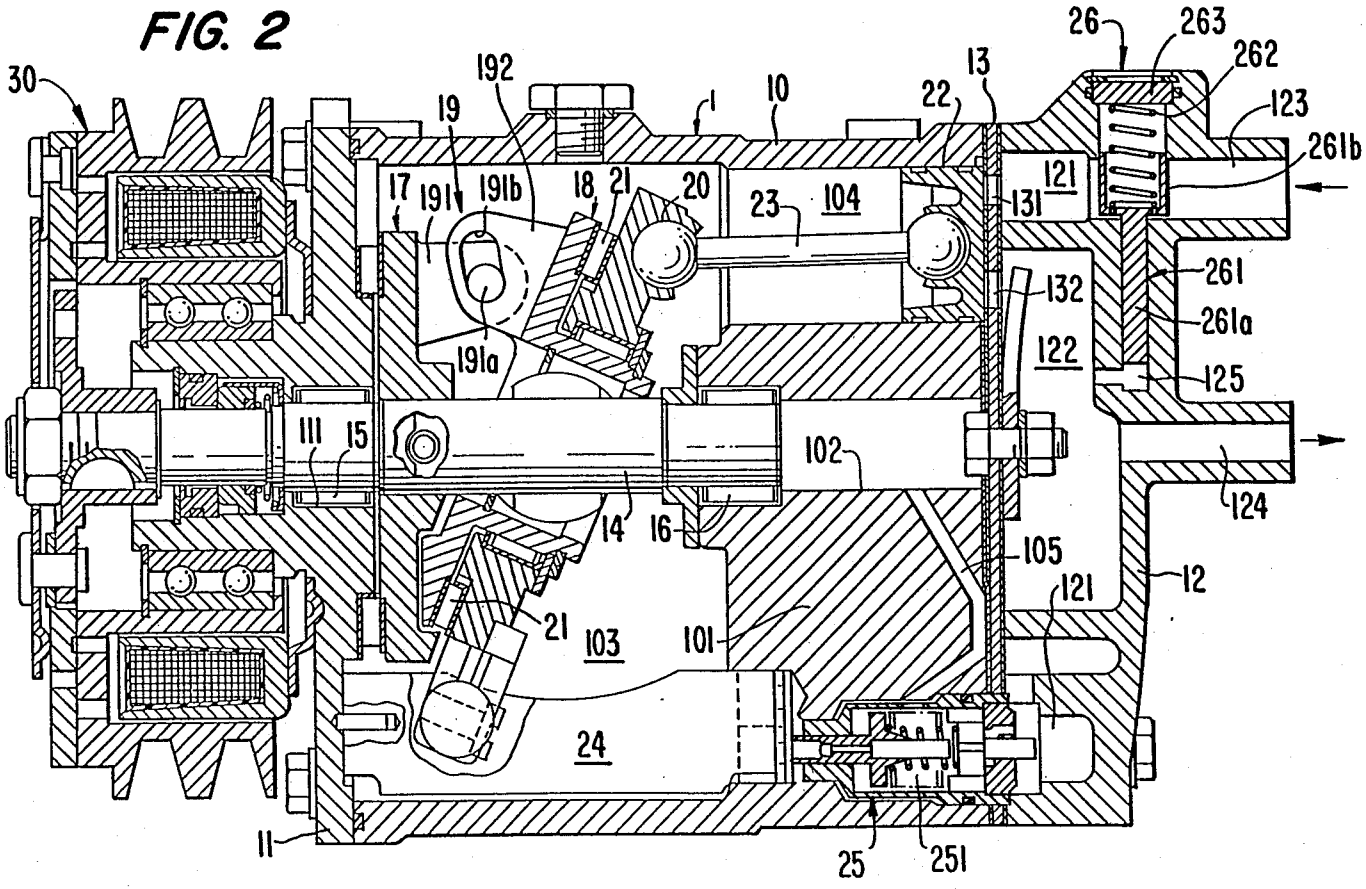
FIG. 2 is a cross-sectional view of a wobble plate type compressor including a variable displacement mechanism and having a passageway control mechanism in accordance with a first embodiment of this invention.
Figure 4:
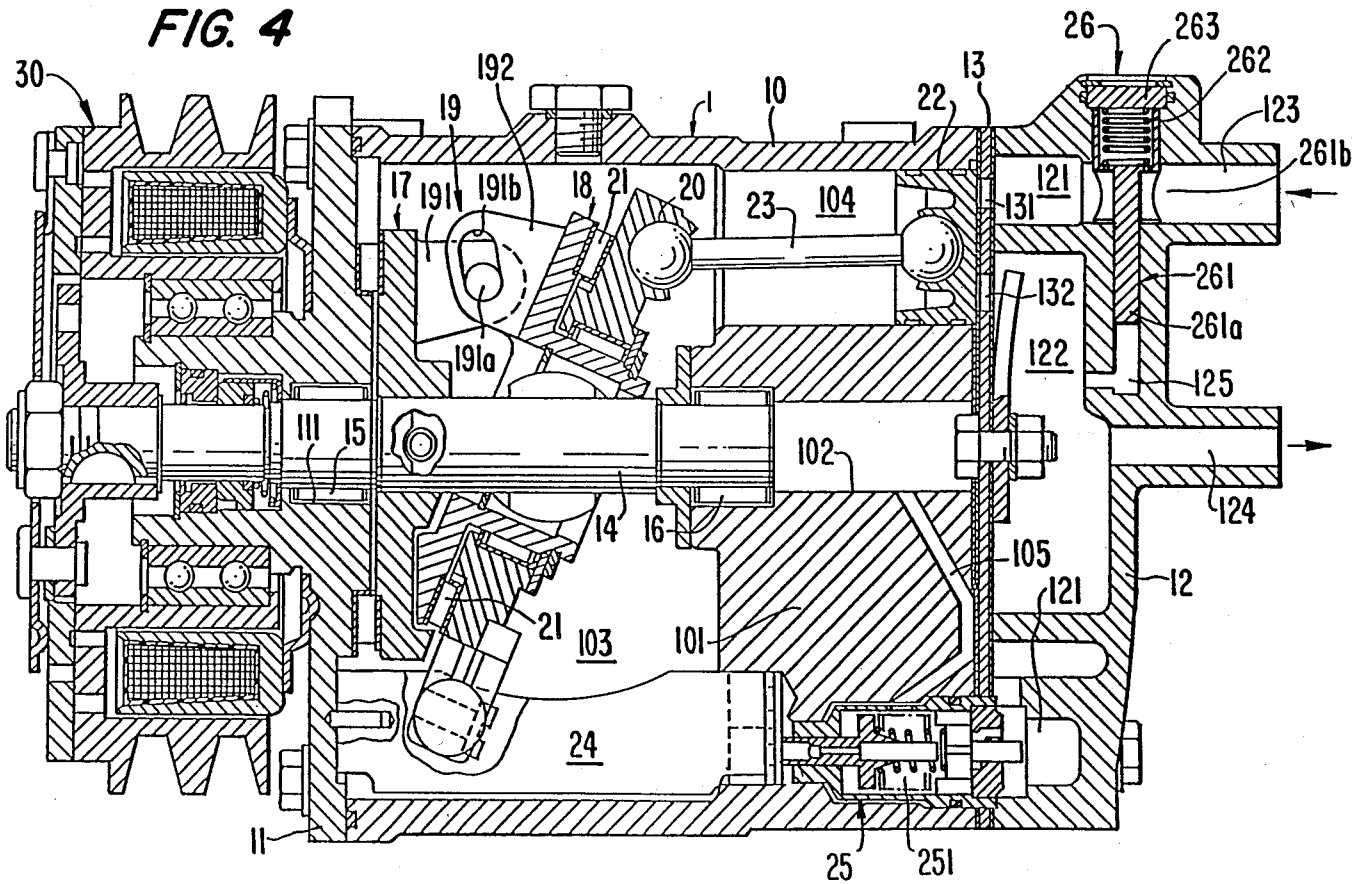
FIG. 4 is a cross-sectional view illustrating the operation of the compressor shown in FIG. 2.

Referring to FIGS. 2 and 3, the construction of a wobble plate type compressor having a variable displacement mechanism is shown. Compressor 1 includes a closed housing assembly formed by a cylindrical compressor housing 10, front end plate 11 and a rear end plate in the form of cylinder head 12. Cylinder block 101 and crank chamber 103 are located in compressor housing 10. Front end plate 11 is attached to one end surface of compressor housing 10, and cylinder head 12 is disposed on the opposite end surface of compressor housing 10 and is fixedly mounted on one end surface of cylinder block 101 through a valve plate 13. Opening 111 is formed in the central portion of front end plate 11 to receive a drive shaft 14.

Drive shaft 14 is rotatably supported in front end plate 11 through a bearing 15. An inner end portion of drive shaft 14 also extends into central bore 102 formed in the central portion of cylinder block 101, and is rotatably supported therein by a bearing 16. A rotor 17, disposed in the interior of crank chamber 103, is connected to drive shaft 14 to be rotatable therewith, and engages an inclined plate 18 through a hinge mechanism 19. Wobble plate 20 is disposed on the opposite side surface of inclined plate 18 and bears against plate 18 through a bearing 21.

Hinge mechanism 19 comprises tab portion 191, including pin portion 191*a*, formed on the inner end surface of rotor 17, and tab portion 192, having longitudinal hole 191*b*, formed on one end surface of inclined plate 18. The angle of inclination of inclined plate 18 with respect to drive shaft 14 can be adjusted by hinge mechanism 19.

A plurality of equiangularly spaced cylinders 104, one of which is shown in FIG. 2, are formed in cylinder block 101, and a piston 22 is reciprocatingly disposed within each cylinder 104. Each piston 22 is connected to wobble plate 20 through a connecting rod 23, i.e., one end of each connecting rod 23 is connected to wobble plate 20 with a ball joint and the other end of each connecting rod 23 is connected to one of pistons 22 with a ball joint. A guide bar 24 extends within crank chamber 103 of compressor housing 10. The lower end portion of wobble plate 20 engages guide bar 24 to enable wobble plate 20 to reciprocate along the guide bar while preventing rotational motion.

Pistons 22 are thus reciprocated in cylinders 104 by a drive mechanism formed of drive shaft 14, rotor 17, inclined plate 18, wobble plate 20 and connecting rods 23. Drive shaft 14 and rotor 17 are rotated and inclined plate 18, wobble plate 20 and connecting rods 23 function as a coupling mechanism to convert the rotational motion of the rotor into reciprocating motion of the pistons.

Cylinder head 12 is provided with a suction chamber 121 and a discharge chamber 122, which communicate with cylinder 104 through suction hole 131 and discharge hole 132, respectively, formed through valve plate 13. Cylinder head 12 is also provided with an inlet port 123 and an outlet port 124 which place suction chamber 121 and discharge chamber 122 in fluid communication with an external refrigerant circuit.

A bypass hole or passageway 105 is formed in cylinder block 101 to communicate between suction chamber 121 and crank chamber 103 through central bore 102. Communication between chambers 121 and 103 is controlled by a control valve mechanism 25. Control valve mechanism 25 is located between cylinder block 101 and cylinder head 12, and includes bellows element 251.

Bellows element 251 is operated to control communication between the chambers responsive to the pressure difference between the pressure of refrigerant in suction chamber 121 and the pressure in crank chamber 103.

Passageway control mechanism 26 is disposed within one end of cylinder head 12 and comprises a valve 261 which includes piston portion 261*a* and valve portion 261*b*, coil spring 262, and screw mechanism 263 which includes spring seat 263*a*. Cylinder portion 125 is formed within cylinder block 12 to permit communication between suction chamber 121 and inlet port 123 and discharge chamber 122. Piston portion 261*a* of valve 261 is reciprocably fitted within cylinder portion 125. Valve portion 261*b* varies the opening area of the passageway between suction chamber 121 and inlet port 123 in accordance with operation of piston portion 261*a*. Coil spring 262 is disposed between valve portion 261*b* and spring seat 263*a*, and is attached to valve portion 261*b* at one end and supported on the inner end of spring seat 263*a* at the other end. Coil spring 262 normally urges valve portion 261*b* to close the opening against the refrigerant pressure in discharge chamber 122. Spring seat 263*a* adjusts the recoil strength of coil spring 262 by screwing screw mechanism 263.

Further, with reference to FIG. 3, the operation of passageway control mechanism 26 is described.

When compressor 1 is started by a driving source through electromagnetic clutch 30 (FIG. 2), if the refrigerant pressure in suction chamber 121 equals the pressure in discharge chamber 122, piston portion 261*a* of valve 261 is urged downward to close the passageway opening between suction chamber 121 and inlet port 123. Thereafter, when compressor 1 is driven by rotation of drive shaft 14, the flow volume of refrigerant which is sucked into suction chamber 121 is limited by the size of the passageway opening, and the refrigerant pressure in cylinder 104 is rapidly reduced. The refrigerant level in crank chamber 103, therefore, becomes higher than that in suction chamber 121, thereby increasing the pressure difference between the two chambers. The high fluid pressure in crank chamber 103 acts on the rear surface of piston 22 (FIG. 2) thereby reducing the angle of inclination of inclined plate 18 with respect to drive shaft 14, and the nutational motion of wobble plate 20 is also reduced. This decreases the stroke volume of piston 22 and, as a result, the volume of refrigerant gas taken into cylinder 104 decreases and the capacity of the compressor is also decreased.

Figure 5:
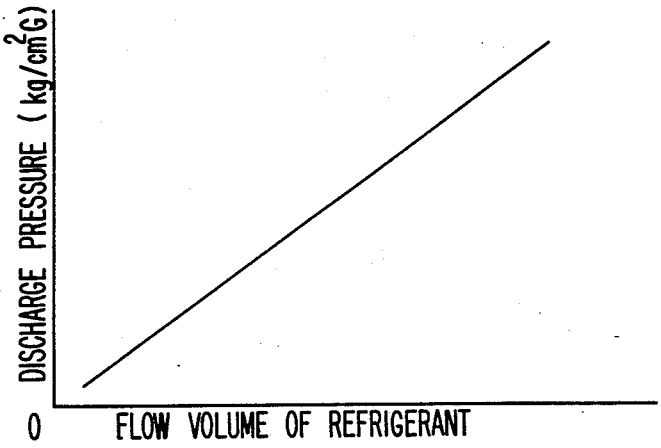
FIG. 5 is a graph illustrating the relationship between discharge pressure and the flow volume of refrigerant.

If compressor 1 is continuously driven, refrigerant pressure in discharge chamber 122 will increase as refrigerant at inlet port 123 is gradually sucked into suction chamber 121 through the opening area. Piston portion 261*a* of valve 261 is then urged upward against the recoil strength of coil spring 262 by the increased refrigerant pressure discharged in discharge chamber 122. As shown in FIG. 5, when the opening area remains constant, the discharge pressure increases in proportion to the flow of refrigerant. Accordingly, as the flow volume of refrigerant increases, and the refrigerant pressure discharged in discharge chamber 125 becomes higher than the recoil strength of coil spring 262, piston portion 261*a* of valve 261 is moved upward within cylinder portion 125 together with valve portion 261*b*, thereby increasing the opening area of the passageway between suction chamber 121 and inlet port 123. If the discharge pressure becomes higher than a certain value, e.g., 13 $kg/cm^2G$, valve 261 is moved upward to open the opening area to its maximum value.

Figure 6:
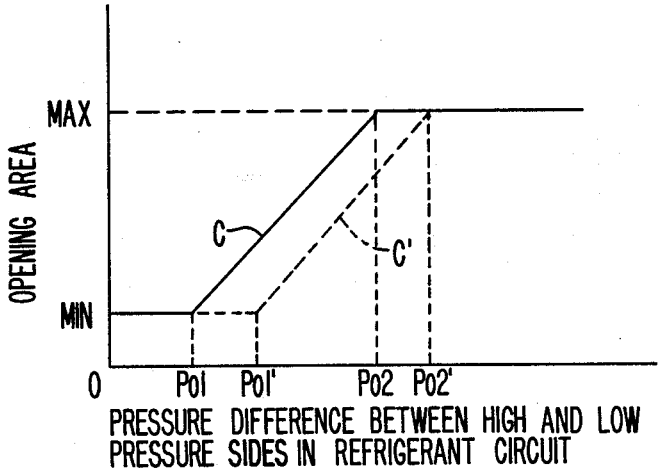
FIG. 6 is a graph illustrating the relationship between the opening area of the passageway and the pressure difference between high and low pressure sides of a refrigerant circuit.

Referring to FIG. 6, the relationship between the size of the passageway opening and the pressure difference between high and low pressure sides in a refrigerant circuit is illustrated by solid line C. The opening area increases with an increase in the pressure difference. Thus, when the pressure difference is less than Po1, the opening area is at its minimum value, and when the pressure difference is higher than Po2, the opening area is at its maximum value. The minimum and maximum opening area values can be readily predetermined by suitable selection of the size of valve 261. The value of pressure difference Po2−Po1, which causes the opening area to open from its minimum value to the maximum value, can also be predetermined by suitably varying the recoil strength of coil spring 262 by adjusting the position of spring seat 263*a*. Dotted line C′ illustrates the relationship between the size of the passageway opening and the pressure difference between high and low pressure sides in a refrigerant circuit where the recoil strength of coil spring 262 has been increased by adjusting spring seat 263*a* downwardly.

Figure 7:
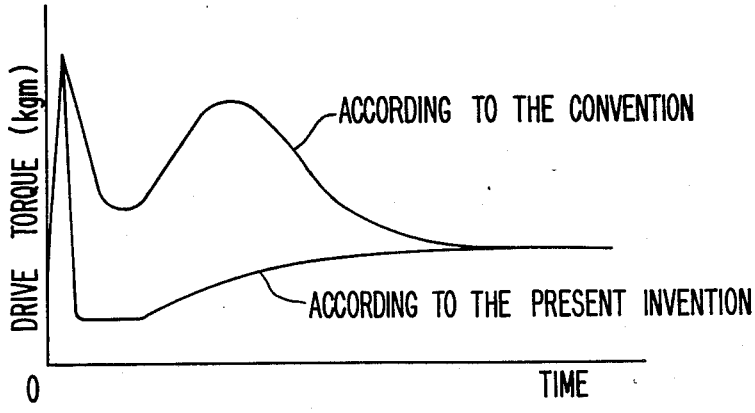
FIG. 7 is a graph illustrating the relationship between drive torque and the driving time of a compressor.

Referring to FIG. 7, the relationship between drive torque and driving time of a compressor is shown. As illustrated in the figure, the drive torque changes in a refrigerant circuit having a passageway control mechanism in accordance with the present invention are small as compared with that in a conventional refrigerant circuit. In a conventional refrigerant circuit, the pressure in the suction chamber of the compressor must be maintained at about 2 kg/cm$^2$G to prevent frost from forming on the evaporator even if the flow volume of refrigerant is reduced as shown by line d in FIG. 8 (*a*). However, when the flow volume of refrigerant is increased, the pressure at the outlet side of the evaporator is also increased by the pressure loss in the passageway between the inlet of the compressor and the outlet of evaporator as sown by dotted line C in FIG. 8 (*a*). Accordingly, the pressure difference is increased thereby creating the problems mentioned above with respect to previous variable capacity systems.

Figure 8A:
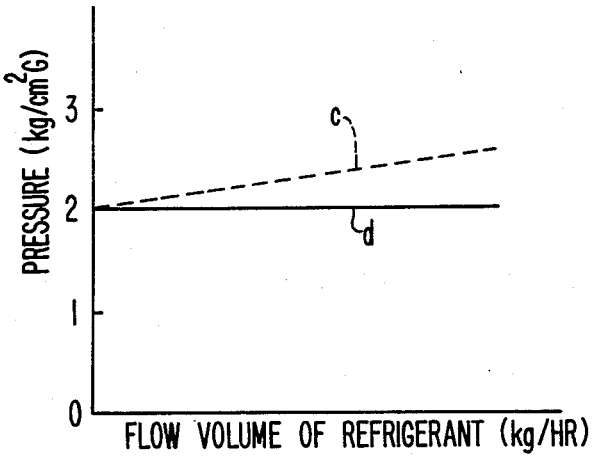
FIG. 8 (*a*) is a graph illustrating the relationship between pressure and flow volume of refrigerant.
Figure 8B:
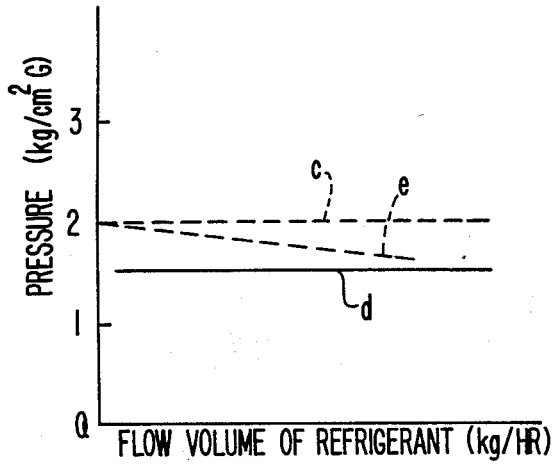

By way of contrast, in the present invention the passageway control mechanism operates to increase the passageway opening with an increase in the pressure difference resulting from an increase in the flow volume of refrigerant so that the pressure at the inlet side of the passageway control mechanism is decreased as shown by dotted line e in FIG. 8 (*b*). Accordingly, the pressure at the outlet side of the evaporator is not influenced by the flow volume of refrigerant, and can be maintained at a selected value. The temperature of air passing through the evaporator can, therefore, also be maintained at a selected value.

Figure 9:
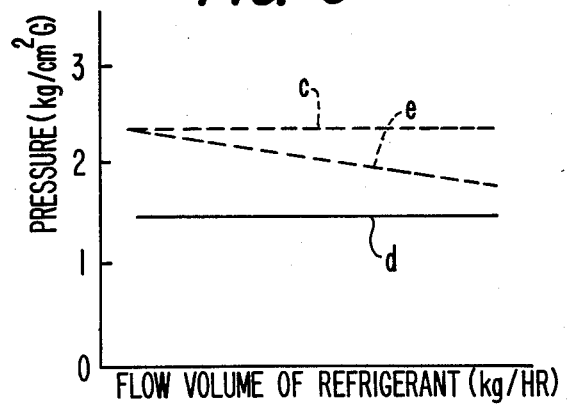
FIG. 9 is a graph illustrating the relationship between pressure and flow volume of refrigerant.

The temperature of air which is passed through an evaporator is dependent upon the refrigerant pressure at the outlet side of the evaporator. The pressure of refrigerant at the outlet side of the evaporator can be optionally predetermined by adjusting the passageway control mechanism. For instance, as mentioned above, the relationship between the size of the passageway opening and the pressure difference between high and low pressure sides in a refrigerant circuit can be changed from line C to line C′ (FIG. 6) by varying the recoil strength of coil spring 262. Thus, the pressure at the inlet side of passageway control mechanism 26 increases as shown by line e in FIG. 9 and the pressure at the outlet of evaporator 5 also increases therewith as shown by line C in FIG. 9.

Figure 10:
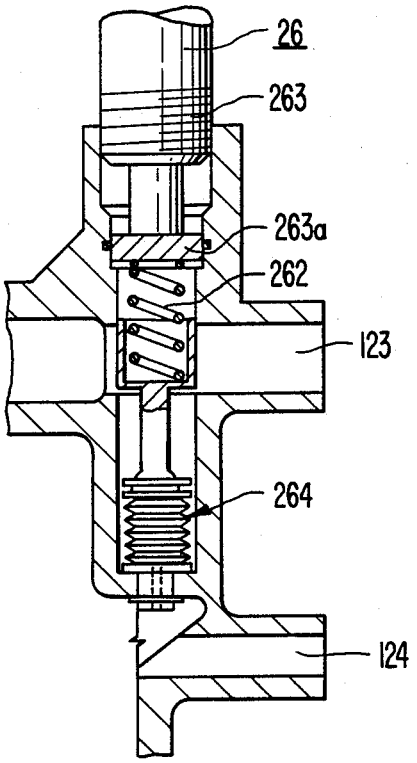
FIG. 10 is a cross-sectional view of a passageway control mechanism in accordance with a second embodiment of this invention.
Figure 11:
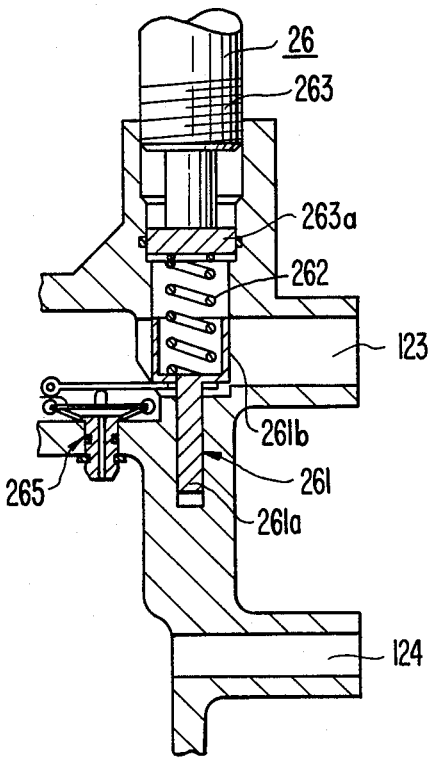
FIG. 11 is a cross-sectional view of a passageway control mechanism in accordance with a third embodiment of this invention.

This invention is not limited to the above mentioned embodiment. In the above embodiment, a passageway control mechanism is formed within one end of a cylinder block of a compressor. However, the efficiency and object of this invention can also be achieved by disposing the passageway control mechanism anywhere between an outlet side of an evaporator and an inlet side of a compressor or in an evaporator. Further, although in the above embodiment, this invention is applied to a refrigerant circuit including an expansion valve, this invention can be also applied to a refrigerant circuit including an orifice. The efficiency and object of this invention can, thus, be achieved by disposing a passageway control mechanism between an outlet side of an accumulator and an inlet side of a compressor. In the above embodiment, a cylinder and a valve with a piston portion is used as the drive means of the passageway control mechanism, however, other drive means responsive to pressure differences, e.g., bellows 264 as shown in FIG. 10 or diaphram 265 as shown in FIG. 11, can be also used. In addition, electromagnetic force, outer pressure force and bimetal can be used to replace the spring mechanism.

Although a preferred embodiment of the invention has been described in considerable detail, those skilled in the art will appreciate that this is only one embodiment of the invention and that other variations and modifications may be made thereto within the scope of the present invention as defined by the appended claims.

I claim:

1. In a refrigerant circuit having passageway control means, and including a compressor, a condenser and an evaporator connected to each other in series, the improvement comprising:

said passageway control means disposed between an outlet side of said evaporator and an inlet side of said compressor and operating to change the size of an opening area of a passageway therebetween responsive to the pressure difference between a suction chamber and a discharge chamber of the compressor, wherein said passageway control means operates to change the size of the opening area of said passageway into a large area responsive to a large pressure difference and into a small area responsive to a small pressure difference.

2. The refrigerant circuit of claim 1 wherein said compressor is a compressor with a variable displacement mechanism.

3. The refrigerant circuit of claim 2 wherein said passageway control means comprises a valve mechanism including a piston portion and a valve portion, a spring seat, and a coil spring disposed between the valve mechanism and the spring seat.

4. The refrigerant circuit of claim 2 wherein said passageway control means comprises a valve mechanism including a bellows portion and a valve portion, a spring seat, and a coil spring disposed between the valve mechanism and the spring seat.

5. The refrigerant circuit of claim 2 wherein said passageway control means comprises a valve mechanism including a diaphragm portion and a valve portion, a spring seat, and a coil spring disposed between the valve mechanism and the spring seat.

6. The refrigerant circuit of claim 1 wherein said passageway control means comprises a valve mechanism including a piston portion and a valve portion, a spring seat, and a coil spring disposed between the valve mechanism and the spring seat.

7. The refrigerant circuit of claim 1 wherein said passageway control means comprises a valve mechanism including a diaphragm portion and a valve portion, a spring seat, and a coil spring disposed between the valve mechanism and the spring seat.

8. The refrigerant circuit of claim 1 wherein said passageway control means comprises a valve mechanism including a bellows portion and a valve portion, a spring seat, and a coil spring disposed between the valve mechanism and the spring seat.

9. The refrigerant circuit of claim 1 wherein said passageway control means comprises a valve mechanism including a bellows portion and a valve portion, a spring seat, and a coil spring disposed between the valve mechanism and the spring seat.

10. The refrigerant circuit of claim 1 wherein said passageway control means comprises a valve mechanism including a bellows portion and a valve portion, a spring seat, and a coil spring disposed between the valve mechanism and the spring seat.

11. The refrigerant circuit of claim 1 wherein said passageway control means comprises a valve mechanism including a diaphragm portion and a valve portion, a spring seat, and a coil spring disposed between the valve mechanism and the spring seat.

12. The refrigerant circuit of claim 1 wherein said passageway control means comprises a valve mechanism including a diaphragm portion and a valve portion, a spring seat, and a coil spring disposed between the valve mechanism and the spring seat.

* * * * *